US008860645B2

(12) United States Patent
Chen et al.

(10) Patent No.: US 8,860,645 B2
(45) Date of Patent: Oct. 14, 2014

(54) ADAPTIVE INVERSION DRIVING FOR TFT-LCD

(75) Inventors: Jun Chen, Hong Kong (CN); Cheung Fai Lee, Hong Kong (CN); Yiu Sang Lei, Hong Kong (CN)

(73) Assignee: Solomon Systech Limited, Hong Kong (CN)

( * ) Notice: Subject to any disclaimer, the term of this patent is extended or adjusted under 35 U.S.C. 154(b) by 180 days.

(21) Appl. No.: 13/425,050

(22) Filed: Mar. 20, 2012

(65) Prior Publication Data

US 2013/0249880 A1 Sep. 26, 2013

(51) Int. Cl.
*G09G 3/36* (2006.01)

(52) U.S. Cl.
USPC ..... 345/96; 345/54; 345/87; 345/209

(58) Field of Classification Search
CPC ..... G09G 3/3614; G09G 2310/0254; G09G 3/3611; G09G 2320/0204; G09G 2320/0209; G09G 2320/0247; G09G 2320/0266
USPC ..... 345/96, 209, 87, 54, 690; 349/37
See application file for complete search history.

(56) References Cited

U.S. PATENT DOCUMENTS

2006/0097967 A1* 5/2006 Lee ..... 345/87
2006/0114220 A1* 6/2006 Wang ..... 345/103
2011/0102471 A1* 5/2011 Hsu et al. ..... 345/690

* cited by examiner

*Primary Examiner* — Koosha Sharifi-Tafreshi
(74) *Attorney, Agent, or Firm* — Finnegan, Henderson, Farabow, Garrett & Dunner LLP

(57) ABSTRACT

A scan driving method for LCD panel comprises varying of polarity pattern adaptive to column data, wherein polarity patterns are dynamically determined from row to row, based on analysis of column drive signals for present and previous rows to obtain a parametric value and determination to either keep default polarity pattern or switch to alternate polarity pattern in accordance with parametric value obtained. Columns are regarded as in one or multiple groups for consideration. A total drive differential value is used as parameter, switching from default polarity pattern to alternate polarity pattern when a threshold is exceeded, to reduce total drive differential going from row to row. Column inversion is a default and dot inversion is an alternate.

12 Claims, 18 Drawing Sheets

FIG. 1a

PRIOR ART

| | | | | | | | | | |
|---|---|---|---|---|---|---|---|---|---|
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |

FIG. 1b

PRIOR ART

| | | | | | | | | | |
|---|---|---|---|---|---|---|---|---|---|
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |

FIG. 2a

PRIOR ART

| | | | | | | | | | |
|---|---|---|---|---|---|---|---|---|---|
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |
| + | − | + | − | + | − | + | − | + | − |

FIG. 2b

PRIOR ART

| | | | | | | | | | |
|---|---|---|---|---|---|---|---|---|---|
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |
| − | + | − | + | − | + | − | + | − | + |

FIG. 3a

PRIOR ART

| | | | | | | | | | |
|---|---|---|---|---|---|---|---|---|---|
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |

FIG. 3b

PRIOR ART

| | | | | | | | | | |
|---|---|---|---|---|---|---|---|---|---|
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |
| − | + | − | + | − | + | − | + | − | + |
| + | − | + | − | + | − | + | − | + | − |

FIG. 4a

PRIOR ART

Frame N

| | | | | | | |
|---|---|---|---|---|---|---|
| 1 | + | − | + | − | ... | ... |
| 2 | + | − | + | − | ... | ... |
| 3 | + | − | + | − | ... | ... |
| ⋮ | ⋮ | ⋮ | ⋮ | ⋮ | ... | ... |
| n-1 | + | − | + | − | ... | ... |
| n | + | − | + | − | ... | ... |
| n+1 | − | + | − | + | ... | ... |
| n+2 | − | + | − | + | ... | ... |
| n+3 | − | + | − | + | ... | ... |
| ⋮ | ⋮ | ⋮ | ⋮ | ⋮ | ... | ... |
| 2n-1 | − | + | − | + | ... | ... |
| 2n | − | + | − | + | ... | ... |

Frame N+1

| | | | | | | |
|---|---|---|---|---|---|---|
| 1 | + | − | + | − | ... | ... |
| 2 | + | − | + | − | ... | ... |
| 3 | + | − | + | − | ... | ... |
| ⋮ | ⋮ | ⋮ | ⋮ | ⋮ | ... | ... |
| n-1 | + | − | + | − | ... | ... |
| n | − | + | − | + | ... | ... |
| n+1 | − | + | − | + | ... | ... |
| n+2 | − | + | − | + | ... | ... |
| n+3 | − | + | − | + | ... | ... |
| ⋮ | ⋮ | ⋮ | ⋮ | ⋮ | ... | ... |
| 2n-1 | − | + | − | + | ... | ... |
| 2n | + | − | + | − | ... | ... |

Frame N+2

| | | | | | | |
|---|---|---|---|---|---|---|
| 1 | + | − | + | − | ... | ... |
| 2 | + | − | + | − | ... | ... |
| 3 | + | − | + | − | ... | ... |
| ⋮ | ⋮ | ⋮ | ⋮ | ⋮ | ... | ... |
| n-1 | − | + | − | + | ... | ... |
| n | − | + | − | + | ... | ... |
| n+1 | − | + | − | + | ... | ... |
| n+2 | − | + | − | + | ... | ... |
| n+3 | − | + | − | + | ... | ... |
| ⋮ | ⋮ | ⋮ | ⋮ | ⋮ | ... | ... |
| 2n-1 | + | − | + | − | ... | ... |
| 2n | + | − | + | − | ... | ... |

. . . . . .

Frame N+n-1

| | | | | | | |
|---|---|---|---|---|---|---|
| 1 | − | + | − | + | ... | ... |
| 2 | + | − | + | − | ... | ... |
| 3 | + | − | + | − | ... | ... |
| ⋮ | ⋮ | ⋮ | ⋮ | ⋮ | ... | ... |
| n-1 | + | − | + | − | ... | ... |
| n | + | − | + | − | ... | ... |
| n+1 | + | − | + | − | ... | ... |
| n+2 | − | + | − | + | ... | ... |
| n+3 | − | + | − | + | ... | ... |
| ⋮ | ⋮ | ⋮ | ⋮ | ⋮ | ... | ... |
| 2n-1 | − | + | − | + | ... | ... |
| 2n | − | + | − | + | ... | ... |

Display Driver IC and COM on a LCD panel

Equivalent Model of COM loading

FIG. 7a

Column drive pattern by default column inversion

| | Col 1 | Col 2 | Col 3 | Col 4 | Col 5 | Col 6 |
|---|---|---|---|---|---|---|
| Row 1 | +VH | -VL | +VH | -VL | +VH | -VL |
| Row 2 | +VL | -VH | +VL | -VH | +VL | -VH |
| Row 3 | +VH | -VL | +VL | -VH | +VH | -VL |
| Row 4 | +VL | -VH | +VL | -VH | +VL | -VH |
| Row 5 | +VH | -VL | +VH | -VL | +VH | -VL |
| Row 6 | +VL | -VH | +VL | -VH | +VL | -VH |
| ⋮ | | | | | | |

FIG. 7b

Column drive pattern by adaptive inversion

Display pattern in adaptive inversion

| | Col 1 | Col 2 | Col 3 | Col 4 | Col 5 | Col 6 |
|---|---|---|---|---|---|---|
| Row 1 | +VH | -VL | +VH | -VL | +VH | -VL |
| Row 2 | -VL | +VH | -VL | +VH | -VL | +VH |
| Row 3 | +VH | -VL | -VL | +VH | +VH | -VL |
| Row 4 | -VL | +VH | -VL | +VH | -VL | +VH |
| Row 5 | +VH | -VL | +VH | -VL | +VH | -VL |
| Row 6 | -VL | +VH | -VL | +VH | -VL | +VH |
| ⋮ | | | | | | |

706 707 708

Waveforms of column drive signals by column inversion

Waveforms of column drive signals by adaptive inversion

Waveforms of Vcom voltage by column inversion

Case 1: Small Vcom loading

Case 2: Large Vcom loading

Waveforms of Vcom voltage by adaptive inversion

FIG. 10a

Image Pattern

| | C1 | C2 | C3 | C4 | C5 | C6 | C7 | C8 |
|---|---|---|---|---|---|---|---|---|
| R1 | VH | VH | VH | VL | VH | VL | VH | VH |
| R2 | VH | VH | VH | VL | VH | VL | VH | VH |
| R3 | VH | VH | VH | VL | VH | VL | VH | VH |
| R4 | VH | VH | VL | VH | VL | VH | VH | VH |
| R5 | VH | VH | VH | VL | VH | VL | VH | VH |
| R6 | VH | VH | VL | VH | VL | VH | VH | VH |
| R7 | VH | VH | VH | VL | VH | VL | VH | VH |
| R8 | VH | VH | VL | VH | VL | VH | VH | VH |
| R9 | VH | VH | VH | VL | VH | VL | VH | VH |
| R10 | VH | VH | VH | VL | VH | VL | VH | VH |
| R11 | VH | VH | VH | VL | VH | VL | VH | VH |
| R12 | VH | VH | VH | VL | VH | VL | VH | VH |

1001

1002

1003

Column drive pattern for two sequential frames by adaptive inversion

Frame N

| | C1 | C2 | C3 | C4 | C5 | C6 | C7 | C8 |
|---|---|---|---|---|---|---|---|---|
| R1 | +VH | -VH | +VH | -VL | +VH | -VL | +VH | -VH |
| R2 | +VH | -VH | +VH | -VL | +VH | -VL | +VH | -VH |
| R3 | +VH | -VH | +VH | -VL | +VH | -VL | +VH | -VH |
| R4 | -VH | +VH | -VL | +VH | -VL | +VH | -VH | +VH |
| R5 | +VH | -VH | +VH | -VL | +VH | -VL | +VH | -VH |
| R6 | -VH | +VH | -VL | +VH | -VL | +VH | -VH | +VH |
| R7 | +VH | -VH | +VH | -VL | +VH | -VL | +VH | -VH |
| R8 | -VH | +VH | -VL | +VH | -VL | +VH | -VH | +VH |
| R9 | +VH | -VH | +VH | -VL | +VH | -VL | +VH | -VH |
| R10 | +VH | -VH | +VH | -VL | +VH | -VL | +VH | -VH |
| R11 | +VH | -VH | +VH | -VL | +VH | -VL | +VH | -VH |
| R12 | +VH | -VH | +VH | -VL | +VH | -VL | +VH | -VH |

1004

1005

1006

Frame N+1

| C1 | C2 | C3 | C4 | C5 | C6 | C7 | C8 |
|---|---|---|---|---|---|---|---|
| -VH | +VH | -VH | +VL | -VH | +VL | -VH | +VH |
| -VH | +VH | -VH | +VL | -VH | +VL | -VH | +VH |
| -VH | +VH | -VH | +VL | -VH | +VL | -VH | +VH |
| +VH | -VH | +VL | -VH | +VL | -VH | +VH | -VH |
| -VH | +VH | -VH | +VL | -VH | +VL | -VH | +VH |
| +VH | -VH | +VL | -VH | +VL | -VH | +VH | -VH |
| -VH | +VH | -VH | +VL | -VH | +VL | -VH | +VH |
| +VH | -VH | +VL | -VH | +VL | -VH | +VH | -VH |
| -VH | +VH | -VH | +VL | -VH | +VL | -VH | +VH |
| -VH | +VH | -VH | +VL | -VH | +VL | -VH | +VH |
| -VH | +VH | -VH | +VL | -VH | +VL | -VH | +VH |
| -VH | +VH | -VH | +VL | -VH | +VL | -VH | +VH |

FIG. 10b

Image Pattern

| | C1 | C2 | C3 | C4 | C5 | C6 | C7 | C8 |
|---|---|---|---|---|---|---|---|---|
| R1 | VH | VH | VH | VL | VH | VL | VH | VH |
| R2 | VH | VH | VH | VL | VH | VL | VH | VH |
| R3 | VH | VH | VH | VL | VH | VL | VH | VH |
| R4 | VH | VH | VH | VL | VH | VL | VH | VH |
| R5 | VH | VH | VH | VL | VH | VL | VH | VH |
| R6 | VH | VH | VL | VH | VL | VH | VH | VH |
| R7 | VH | VH | VH | VL | VH | VL | VH | VH |
| R8 | VH | VH | VH | VL | VH | VL | VH | VH |
| R9 | VH | VH | VH | VL | VH | VL | VH | VH |
| R10 | VH | VH | VH | VL | VH | VL | VH | VH |
| R11 | VH | VH | VH | VL | VH | VL | VH | VH |
| R12 | VH | VH | VH | VL | VH | VL | VH | VH |

1007

Column drive pattern for two sequential frames by adaptive inversion

Frame N

| | C1 | C2 | C3 | C4 | C5 | C6 | C7 | C8 |
|---|---|---|---|---|---|---|---|---|
| R1 | +VH | -VH | +VH | -VL | +VH | -VL | +VH | -VH |
| R2 | +VH | -VH | +VH | -VL | +VH | -VL | +VH | -VH |
| R3 | +VH | -VH | +VH | -VL | +VH | -VL | +VH | -VH |
| R4 | +VH | -VH | +VH | -VL | +VH | -VL | +VH | -VH |
| R5 | +VH | -VH | +VH | -VL | +VH | -VL | +VH | -VH |
| R6 | -VH | +VH | -VL | +VH | -VL | +VH | -VH | +VH |
| R7 | +VH | -VH | +VH | -VL | +VH | -VL | +VH | -VH |
| R8 | +VH | -VH | +VH | -VL | +VH | -VL | +VH | -VH |
| R9 | +VH | -VH | +VH | -VL | +VH | -VL | +VH | -VH |
| R10 | +VH | -VH | +VH | -VL | +VH | -VL | +VH | -VH |
| R11 | +VH | -VH | +VH | -VL | +VH | -VL | +VH | -VH |
| R12 | +VH | -VH | +VH | -VL | +VH | -VL | +VH | -VH |

1008

Frame N+1

| | C1 | C2 | C3 | C4 | C5 | C6 | C7 | C8 |
|---|---|---|---|---|---|---|---|---|
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | +VH | -VH | +VL | -VH | +VL | -VH | +VH | -VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |

FIG. 11

Image Pattern

| | C1 | C2 | C3 | C4 | C5 | C6 | C7 | C8 |
|---|---|---|---|---|---|---|---|---|
| R1 | VH | VH | VH | VL | VH | VL | VH | VH |
| R2 | VH | VH | VH | VL | VH | VL | VH | VH |
| R3 | VH | VH | VH | VL | VH | VL | VH | VH |
| R4 | VH | VH | VL | VH | VL | VH | VH | VH |
| R5 | VH | VH | VH | VL | VH | VL | VH | VH |
| R6 | VH | VH | VL | VH | VL | VH | VH | VH |
| R7 | VH | VH | VH | VL | VH | VL | VH | VH |
| R8 | VH | VH | VL | VH | VL | VH | VH | VH |
| R9 | VH | VH | VH | VL | VH | VL | VH | VH |
| R10 | VH | VH | VH | VL | VH | VL | VH | VH |
| R11 | VH | VH | VH | VL | VH | VL | VH | VH |
| R12 | VH | VH | VH | VL | VH | VL | VH | VH |

Column drive pattern for two sequential frames by adaptive inversion

Frame N

| | C1 | C2 | C3 | C4 | C5 | C6 | C7 | C8 |
|---|---|---|---|---|---|---|---|---|
| R1 | +VH | -VH | +VH | -VL | +VH | -VL | +VH | -VH |
| R2 | +VH | -VH | +VH | -VL | +VH | -VL | +VH | -VH |
| R3 | +VH | -VH | +VH | -VL | +VH | -VL | +VH | -VH |
| R4 | +VH | -VH | -VL | +VH | -VL | +VH | +VH | -VH |
| R5 | +VH | -VH | +VH | -VL | +VH | -VL | +VH | -VH |
| R6 | +VH | -VH | -VL | +VH | -VL | +VH | +VH | -VH |
| R7 | +VH | -VH | +VH | -VL | +VH | -VL | +VH | -VH |
| R8 | +VH | -VH | -VL | +VH | -VL | +VH | +VH | -VH |
| R9 | +VH | -VH | +VH | -VL | +VH | -VL | +VH | -VH |
| R10 | +VH | -VH | +VH | -VL | +VH | -VL | +VH | -VH |
| R11 | +VH | -VH | +VH | -VL | +VH | -VL | +VH | -VH |
| R12 | +VH | -VH | +VH | -VL | +VH | -VL | +VH | -VH |

1102 1101 1103

Frame N+1

| | C1 | C2 | C3 | C4 | C5 | C6 | C7 | C8 |
|---|---|---|---|---|---|---|---|---|
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | +VL | -VH | +VL | -VH | -VH | +VH |
| | -VH | +VH | -VH | +VL | -VH | +VL | -VH | +VH |
| | -VH | +VH | +VL | -VH | +VL | -VH | -VH | +VH |
| | -VH | +VH | -VH | +VL | -VH | +VL | -VH | +VH |
| | -VH | +VH | +VL | -VH | +VL | -VH | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |
| | -VH | +VH | -VH | +VL | -VH | +VL | -VH | +VH |

ADAPTIVE INVERSION DRIVING FOR TFT-LCD

TECHNICAL FIELD

This disclosure pertains in general to the field of driving TFT-LCD panels, and in particular to a method of scan driving of an LCD panel in a dynamic adaptive inversion manner, consistent with integrated circuit controller driver design and application.

BACKGROUND

Thin-film-transistor liquid crystal display (LCD) has been extensively used for electronic appliances. The LCD panel is composed of a plurality of liquid crystal (LC) cells, arranged in a row-column matrix manner, each cell having an individual signal electrode forming a cell capacitor with a common electrode shared by other cells. To prevent LC polarization that causes image residue and LC damage, LC cells are required to be driven by alternating polarity electric field in order to maintain zero DC balance across the LC, whereby voltage polarity applied to each LC cell is inverted on alternate frames. That is, for each LC cell, if its voltage polarity, which is determined by the voltage of its signal electrode with respect to the common electrode (COM), is driven positive in a present time frame, the voltage polarity is then driven negative in a next time frame.

To display images on a LCD panel, column driving signals with voltage magnitudes corresponding to image gray level data are applied to signal electrodes of LC cells on a row by row manner for each image frame under scan driving control method. The necessity for maintaining zero DC balance in the LC cells can readily be achieved by the classic frame inversion scan driving method for LCD panel, whereby all LC cells on each row are driven by driving signals with same voltage polarity, scanning from row to row, for all rows for a frame, and then with opposite or inverted voltage polarity for the next frame. This frame inversion scheme of scan driving method works well for small panel size, but image crosstalk and flicker problems become visible for high resolution large panels due to inconsistent signal voltages across the LC cells arising from various voltage control difficulties in polarity inversion driving. Other inversion schemes using different polarity patterns for LC cells on a row have been developed to reduce such visible artifacts in the displayed image, including row inversion, column inversion and dot inversion.

FIG. 1 shows voltage polarity pattern for driving LC cells in LCD panel using row inversion. In row inversion, during a frame period, each LC cell on the same row is driven with same voltage polarity which is opposite to voltage polarity for LC cells on adjacent rows, as shown in FIG. 1*a*. The polarity pattern comprises polarity inversion from row to row, but no polarity inversion on a row going from column to column. Then, in the next frame, voltage polarity for each LC cell is inverted, as shown in FIG. 1*b*. Visible artifacts in the displayed image are reduced for certain images in comparison to frame inversion.

It is common in LCD practices to refer to voltage polarity change by various names, such as polarity inversion or polarity reversion or reversed polarity or opposite polarity. A polarity pattern represents a configuration of polarity inversions or polarity changes. Varying of polarity pattern is varying of the configuration of polarity inversions or polarity changes in the polarity pattern. For a polarity pattern of matrix format the polarity pattern is commonly described in terms of polarity inversion or change with respect to row or column intervals.

FIG. 2 shows voltage polarity pattern for driving LC cells in LCD panel using column inversion, polarity inversion going from column to column. In column inversion, during a frame period, each LC cell on the same column is driven with same voltage polarity, which is opposite to voltage polarity for LC cells on adjacent columns, as shown in FIG. 2*a*. The polarity pattern comprises polarity inversion from column to column, but no polarity inversion on a column going from row to row. Then, in the next frame, voltage polarity for each LC cell is inverted, as shown in FIG. 2*b*. Visible artifacts in the displayed image are reduced for certain images in comparison to row inversion.

FIG. 3 shows voltage polarity pattern for driving LC cells in LCD panel using dot inversion. In dot inversion, during a frame period, each LC cell is driven with voltage polarity which is opposite to voltage polarity for surrounding LC cells, as shown in FIG. 3*a*. The polarity pattern comprises polarity inversion from column to column and also from row to row. Then, in the next frame, voltage polarity of each LC cell is inverted, as shown in FIG. 3*b*. Visible artifacts in the displayed image are reduced for certain images in comparison to column inversion. Generally, dot inversion requires increased power consumption in comparison to column inversion.

The aforementioned popular scan driving methods of row inversion, column inversion, and dot inversion have different degrees of sensitivity towards different image data patterns, with regard to visible crosstalk and flicker problems. Row inversion driving is prone to generate visible artifacts for certain horizontal line image data patterns, column inversion driving is prone to generate visible artifacts for certain vertical line image data patterns, and dot inversion driving is prone to generate visible artifacts for certain cell level image date patterns.

Due to such sensitivity to image data patterns, US patent No. 2004/0032386 discloses a time averaging method of voltage polarity patterns for driving LCD. The method comprises a systematic frame by frame row rotation of row divided voltage polarity pattern blocks for the LCD panel, wherein adjacent blocks have opposite column inversion voltage polarity pattern as shown in FIG. 4*a*, relying on a frame time averaging of the visible effects to reduce overall perceived average of crosstalk and flicker visible artifacts. The polarity pattern comprises polarity inversion from column to column within a polarity pattern block, similar to the case of column inversion, except that polarity is also inverted between polarity pattern blocks.

U.S. Pat. No. 6,335,719 discloses a spatial averaging method of voltage polarity patterns for driving LCD. The method comprises an arrangement of voltage polarity pattern blocks for the LCD panel, wherein adjacent blocks have opposite dot inversion voltage polarity patterns as shown in FIG. 4*b*, relying on a spatial averaging effect to reduce overall perceived average of crosstalk and flicker visible artifacts. The polarity pattern comprises polarity inversion from column to column and from row to row within a polarity pattern block, similar to the case of dot inversion, except that polarity is also inverted between polarity pattern blocks.

There are other prior arts employing similar time or spatial or a combination of time and spatial averaging schemes, including U.S. Pat. No. 6,332,876, US 2004/0207592, US 2005/0264598, US 2008/0158125, and US 2010/0097367.

The trend is towards high image resolution and large panel size in display applications. High image resolution and large panel size require high speed driving signals, increasing difficulty in achieving consistent signal voltages across LC cells and thus aggravating visible artifacts. Increasingly complicate inversion schemes result in increasingly difficult hardware integration and high power consumption. To meet requirements for high quality image resolution, large LCD panel size, and stringent hardware limitation and power consumption budget, there is a serious need to improve LCD driving method in continual development.

SUMMARY

There is to provided a scan driving method that is dynamic and adaptive for reducing crosstalk and flicker visible artifacts in image display on LCD panels, comprising dynamic determination of polarity pattern on row by row basis for reducing total drive differential, adaptive to column data, and inverting polarity patterns on frame by frame basis for maintaining DC balance, with considerations for high efficiencies in hardware and power consumption, high compatibility to differences in driving control methods, and high compatibility to differences in panel pixel designs and in applications.

There is also provided a scan driving method for LCD panels comprising varying of polarity pattern with polarity inversion configuration adaptive to column data (adaptive inversion), wherein polarity pattern is dynamically determined on a row to row basis, after the first row, by consideration of column data to be driven for present row and column data for previous row, said consideration including at least an analysis of drive differentials between column drive signals for present and previous rows and a determination of polarity pattern based on the analysis.

There is further provided a scan driving method for LCD panels comprising varying of polarity pattern with polarity inversion configuration adaptive to column data, wherein columns are regarded as either all in one group or categorized into multiple groups for the panel, and wherein polarity pattern is dynamically determined on a row to row basis, after the first row, by consideration of column data to be driven for present row and column data for previous row, said consideration including at least a group by group analysis step to obtain a total drive differential value by summing, for all columns in each group, drive differentials between column drive signals for present and previous rows, taking voltage polarity into account under assumption of a default polarity pattern, and a group by group determination step to either keep default polarity pattern or switch to an alternate polarity pattern for each group, based on the total drive differential value obtained in the analysis step.

The polarity pattern for first row of a frame can employ default polarity pattern or pre-configured polarity pattern.

The polarity pattern for first row of a frame can be inverted from polarity pattern for first row of a previous frame.

Said default polarity pattern can be the polarity pattern of column inversion.

Said alternate polarity pattern can be the polarity pattern of dot inversion.

There is additionally provided a scan driving method for LCD panels comprising varying of polarity pattern with polarity inversion configuration adaptive to column data, wherein polarity pattern for first row is inverted from polarity pattern for first row of previous frame and polarity patterns for subsequent rows are dynamically determined on a row to row basis by consideration of column data to be driven for present row and column data for previous row, said consideration including at least an analysis step to obtain a total drive differential value by summing, for all columns, drive differentials between column drive signals for present and previous rows, taking voltage polarity into account under assumption of default polarity pattern, and an determination step to either keep default polarity pattern or switch to alternate polarity pattern, based on the total drive differential value obtained in the analysis step.

Said analysis step to obtain said total drive differential value can be performed by using either full or partial resolution of column data or corresponding column drive signals.

Said analysis can include scaling said drive signals by scaling coefficients.

Said determination step, to switch to alternative polarity pattern from default polarity pattern, can be based on said total drive differential value obtained from said analysis step exceeding a threshold value, wherein said threshold value may comprise variability between frames, dependent on image data, panel characteristics, or application conditions; and wherein said determination to switch may be skipped over for at least once in a frame time in accordance with application preference.

Columns are regarded as in one or multiple groups for said consideration, wherein for multiple groups, columns in a group are not necessarily contiguously located and group categorization may be according to a combination of cell configuration factors, including position on a row, pixel colors, or sub-frame association.

Said varying of polarity pattern with polarity inversion configuration adaptive to column data scheme further comprises a selection control to employ polarity patterns determined in a previous frame, including inversion of such previous patterns.

Said varying of polarity pattern with polarity inversion configuration adaptive to column data scheme can be configured to reduce totaled column drive differential from row to row, for a group of columns.

Said varying of polarity pattern with polarity inversion configuration adaptive to column data scheme can be configured to reduce power consumption in driving LCD panels.

Said varying of polarity pattern with polarity inversion configuration adaptive to column data scheme can be configured to reduce electrical noise in driving LCD panels.

There is also provided a scan driving method for LCD panels comprising varying of polarity pattern with polarity inversion configuration adaptive to column data, wherein columns are regarded as in one group or multiple groups, and wherein polarity pattern for first row is inverted from polarity pattern for first row of a previous frame and polarity patterns for subsequent rows are dynamically determined on a row to row basis by consideration of column data to be driven for present row and column data for previous row, said consideration including at least a group by group analysis step to obtain a parametric value based on column drive signals for present and previous rows, for each group, taking voltage polarity into account under assumption of default polarity pattern, and a group by group determination step to either keep default polarity pattern or switch to alternate polarity pattern individually for each group, based on the parametric value obtained in said analysis step.

There is further provided a scan driving method for LCD panels comprising varying of polarity pattern with polarity inversion configuration adaptive to column data, wherein polarity pattern is dynamically determined on a row to row basis, by consideration of column data for at least the present row to be driven and column data for previous row, said consideration comprising an analysis of column data and a determination of polarity pattern based on results from said analysis.

There is additionally provided a scan driving method for LCD panels comprising varying of polarity pattern with polarity inversion configuration adaptive to column data, wherein polarity pattern is dynamically adaptive to the image to be displayed, by consideration of image data, said consideration including an analysis of image data and a determination of polarity pattern based on results from said analysis.

BRIEF DESCRIPTION OF THE DRAWINGS

The accompanying drawings, which are incorporated in and constitute a part of this specification, illustrate embodiments of the invention and, together with the description, serve to explain the principles of the invention.

FIG. 1 shows the voltage polarity patterns in accordance with a prior art driving method employing row inversion.

FIG. 2 shows the voltage polarity patterns in accordance with a prior art driving method employing column inversion.

FIG. 3 show the voltage polarity pattern in accordance with a prior art driving method employing dot inversion.

FIGS. 7*a*-7*f* show image data, drive polarity patterns, drive signal waveforms, and Vcom fluctuation waveforms.

FIG. 10 shows two examples of image data and drive polarity patterns for two frames.

FIG. 11 shows an example of image data and drive polarity patterns for two frames.

DESCRIPTION OF THE EMBODIMENTS

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments consistent with the present invention do not represent all implementations consistent with the invention. Instead, they are merely examples of systems and methods consistent with aspects related to the invention as recited in the appended claims.

Figure 4B:
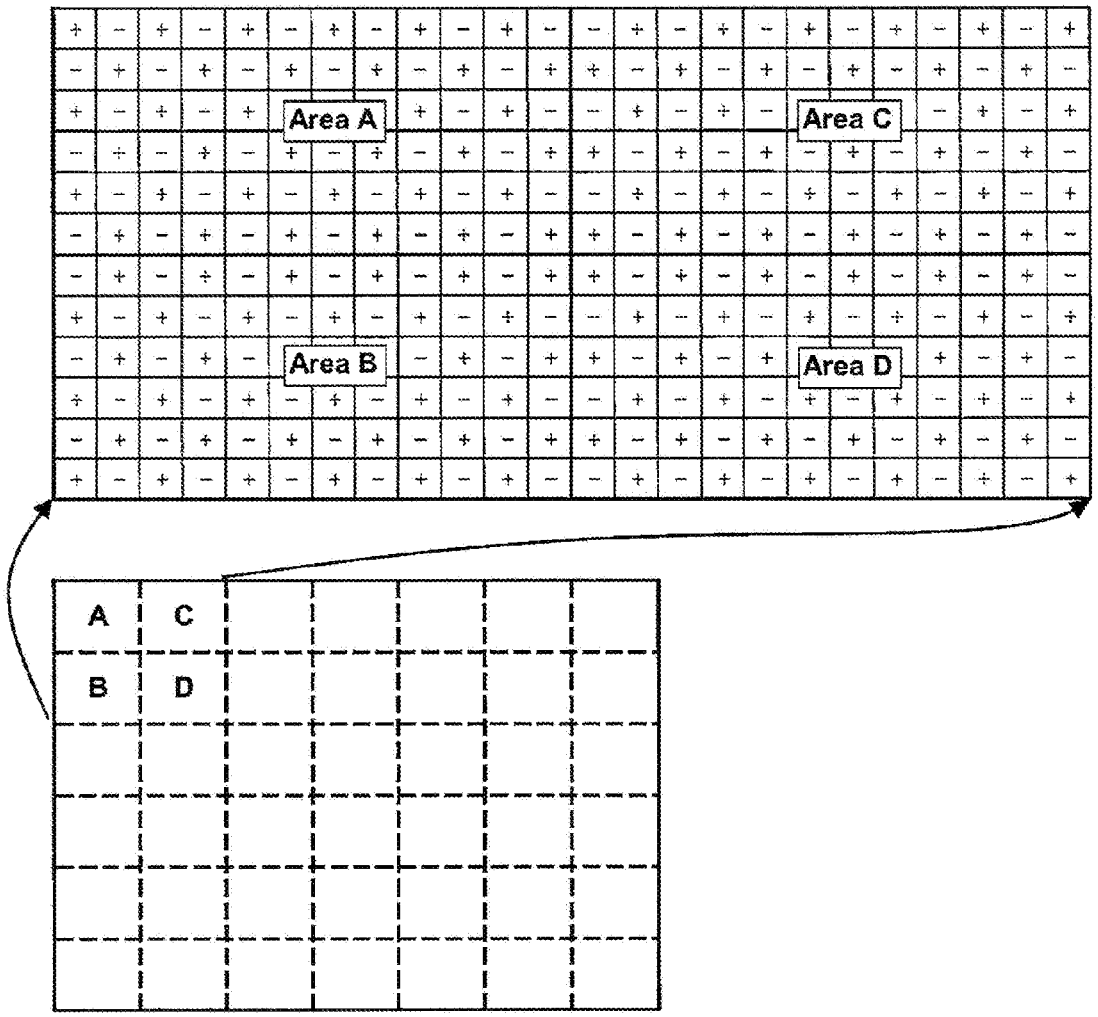
FIG. 4b PRIOR ART
FIG. 4 shows the voltage polarity patterns in accordance with two prior art driving methods; (a) time averaging, (b) and spatial averaging.
Figure 5:
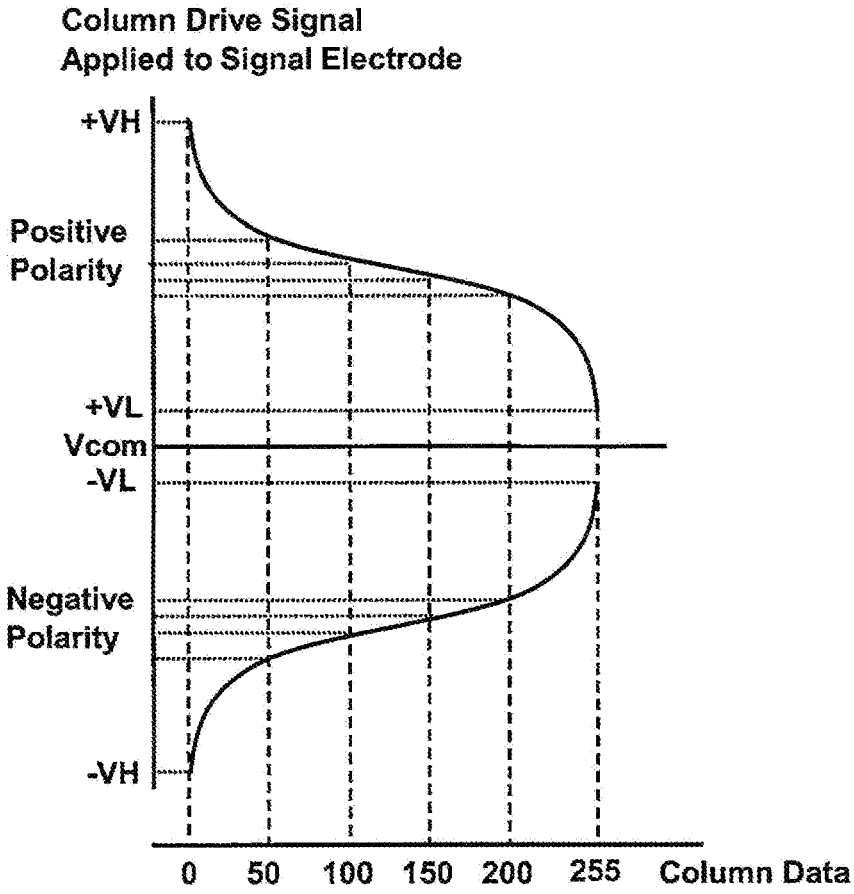
FIG. 5 shows gamma curve of image data versus column drive signals, for positive and negative voltage polarities.

To display images on a LCD panel composed of a plurality of LC cells arranged in a row-column matrix manner, column driving signals with voltage magnitudes corresponding to image gray level data (image data) are applied to signal electrodes of LC cells on a row by row manner, for each image frame under scan driving control. The relationship of column drive signal voltage versus image data, for positive and negative voltage polarities, is described by gamma curve as shown in FIG. 5.

Figure 6A:
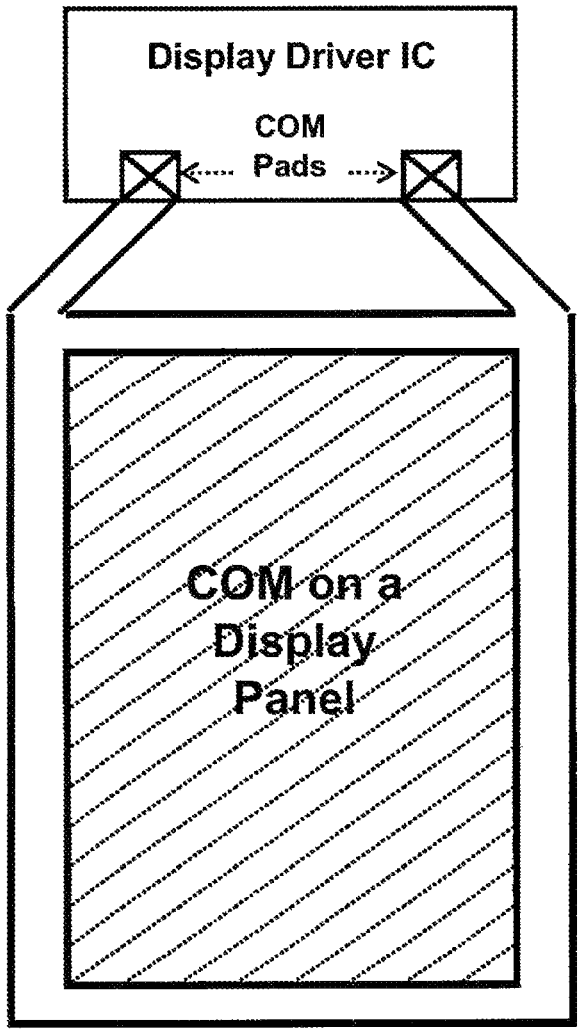
FIG. 6 shows LCD panel resistances and cell capacitances for a model of COM loading.
Figure 6B:
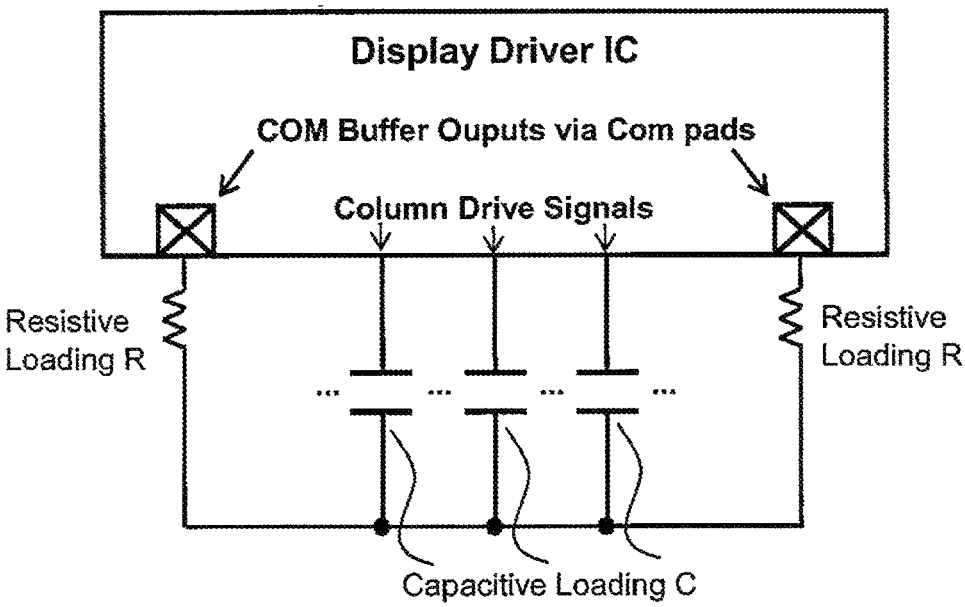

Due to parasitic capacitances between column lines and signal electrodes of LC cells on the LCD panel, simultaneously applied column drive signals are capacitive coupled to COM electrode through inherent LC cell capacitances, inducing fluctuations in COM voltage (Vcom). Fluctuations in Vcom lead to voltage fluctuations across LC cells and consequent image luminance fluctuations. When such fluctuations in Vcom are not settled quick enough, such as within a row time, image crosstalk problems across rows or columns, or image flicker problems between frames, would become undesirable visible artifacts in the displayed image. Vcom fluctuations are occurring at LC cells inside the LCD panel and such fluctuations are not readily suppressible by power supplied externally, due to parasitic resistances associated with COM electrode as illustrated in FIG. 6*a*. The COM resistance (R) and panel capacitance (C) are combined into a model for COM loading as illustrated in FIG. 6*b*. The problem of Vcom fluctuations worsens as COM loading is increased with panel size.

Figure 7C:
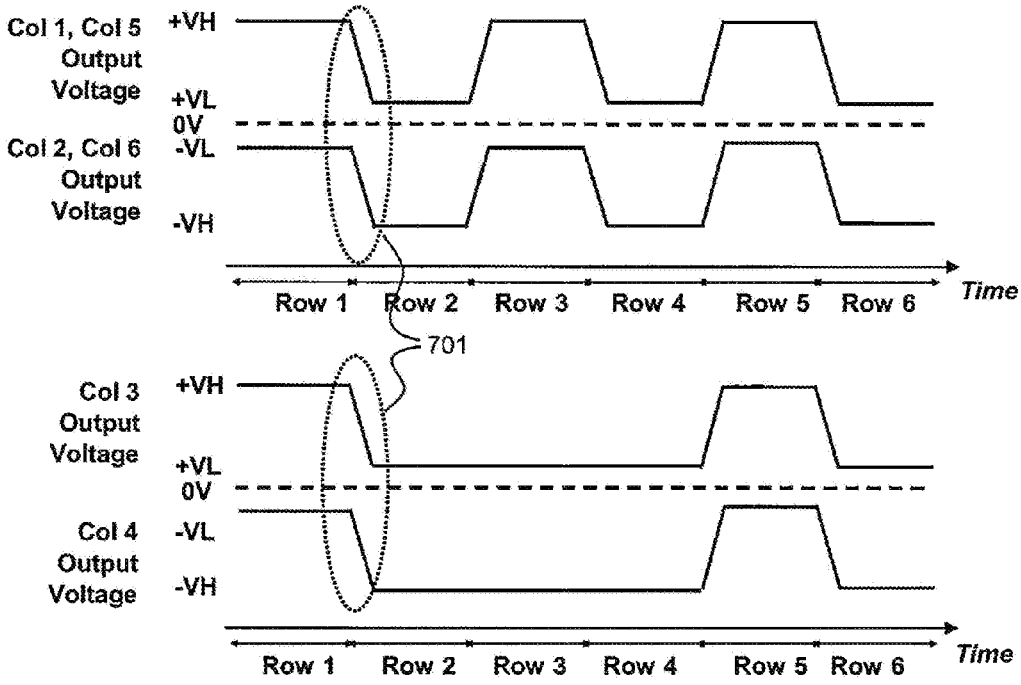
Figure 7D:
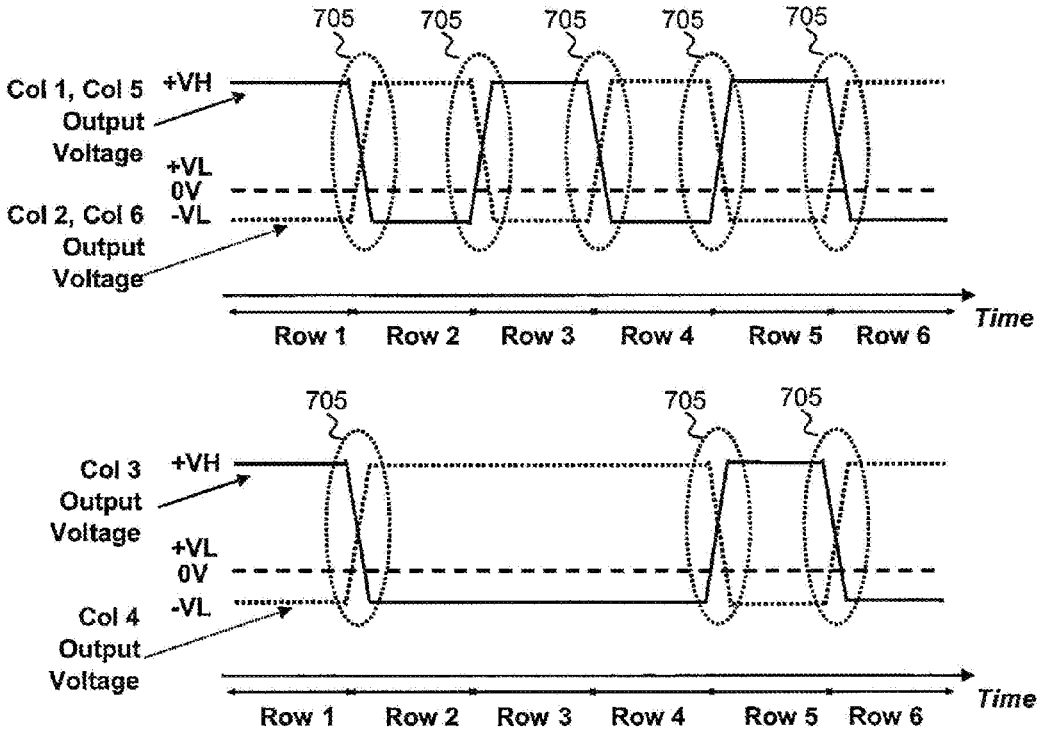
Figure 7E:
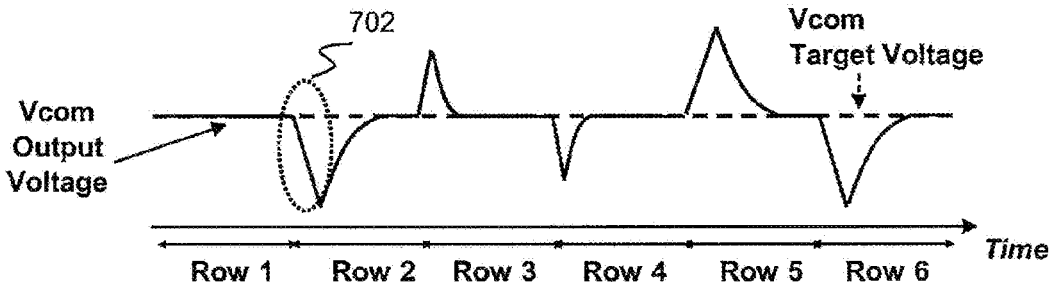
Figure 7E:
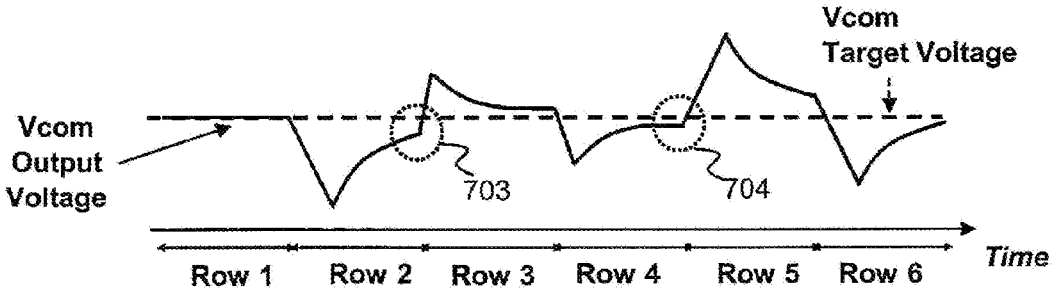

In scan driving of LCD panel from one row to next row, column drive signals are provided to columns; column drive differential from previous signal levels to present signal levels to be driven are dependent on voltage polarities in accordance with polarity pattern, as well as on column signal levels in accordance with image data. For illustration purpose, FIG. 7*a* shows column drive pattern for a small exemplary image of six rows by six columns, where high and low signal levels are represented by VH and VL, using polarity pattern of column inversion driving as commonly used, where the polarity pattern is configured with polarity inversion between adjacent columns. (An actual LCD image typical has hundreds of rows and columns, where variable signal voltages have values ranging between high and low; a small image area is used here for illustration purpose.) FIG. 7*c* shows drive waveforms for corresponding column drive signals and FIG. 7*e* shows simulation waveforms of exemplary Vcom fluctuations due to capacitive coupling across the cells, using column inversion driving. To illustrate actual application results, simulation waveforms shown in FIG. 7*e* are obtained for small and large panel COM loadings as modeled for exemplary actual size panels typically consisting of hundreds of rows and columns of LC cells. As indicated in FIG. 7*e*, when panel COM loading is small (Case 1, FIG. 7*e*), Vcom fluctuations can settle quick enough within row time; but when panel COM loading is large (Case 2, FIG. 7*e*), Vcom fluctuations cannot settle quick enough within row time and Vcom becomes different for different rows (e.g. 703 and 704, FIG. 7*e*) and consequently, crosstalk and flicker artifacts may become visible, since image luminance is sensitive to voltage fluctuations across LC cells.

An embodiment consistent with the present invention comprises varying of polarity pattern with polarity inversion configuration adaptive to column data, wherein polarity pattern is dynamically determined row by row by taking into consideration column data to be driven for present row and column data for previous row, including an analysis to obtain a parametric value to gauge total drive differential and a determination to switch from a default polarity pattern to an alternate polarity pattern when the parametric gauge value, that is the total drive differential value obtained by totaling drive differentials for all the columns on a row, is determined to be too high. Drive differentials from previous signal levels to present signal levels to be driven are dependent on voltage polarities in accordance with polarity pattern, as well as on column signal levels in accordance with image data. By varying polarity pattern adaptively to column data and dynamically on a row by row basis, total drive differential value for drive differentials on the whole can be reduced on a row by row basis, consequently reducing Vcom fluctuations and allowing Vcom to settle to a consistent proper level within row time.

In line with naming practice used for row inversion, column inversion, and dot inversion, the name of adaptive inversion is being used for the present embodiments that comprises varying of polarity pattern for column drive signals on row to row basis, adaptive to column data in accordance with reducing total drive differential value, in scan driving of LCD panel.

In accordance with an embodiment consistent with the present invention, first in the taking into consideration of column data, an analysis is performed to obtain a total drive differential value of column drive differentials, assuming a default polarity pattern (e.g. column inversion polarity pattern is assumed in this example of FIG. 7*a*), by summing drive differentials between drive signal levels going from driving cells on previous row to driving cells on the present row to be driven. This total drive differential value is a parametric value for gauging total drive magnitude of simultaneous column driving signals. For the example in FIG. 7*c*, going from Row 1 to Row 2, a total drive differential value of 6 is obtained for the six columns as a whole, since all six column drive signal differentials (701) are going from high to low (VH to VL and −VL to −VH are equivalent), by assuming a simple value of 1 for drive differential between VH and VL for illustration purpose.

Figure 7F:
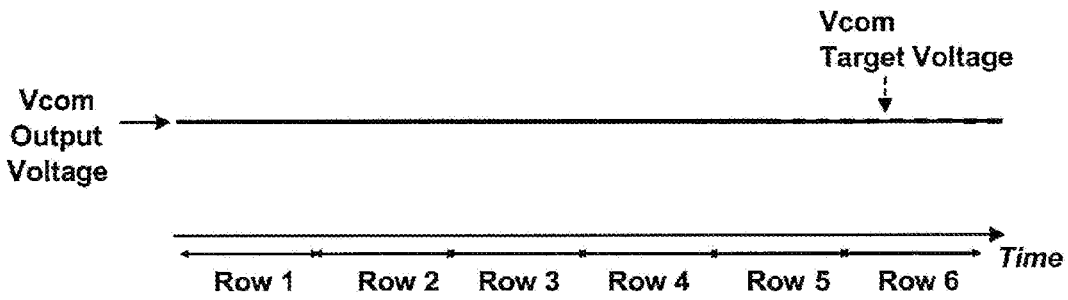

To minimize Vcom fluctuations, a minimum total drive differential value is desirable. Second in the taking into consideration of column data according to an embodiment of the present invention, a determination is made to switch to alternate polarity pattern, considering a total drive differential value of 6 as being too high in comparison to a threshold reference value such as a value of 1 as may be preferred from panel application evaluation. According to an embodiment consistent with the invention, polarity pattern for each row is dynamically determined so as to reduce total drive differential value, in driving column signal levels from those for previous row to those for the present row to be driven. For this example, alternate polarity patterns dynamically determined on row to row basis from Row 2 to Row 6 for the exemplary image are shown in the column drive pattern of FIG. 7*b* and the corresponding waveforms of column drive signals are shown in FIG. 7*d*. As indicated in FIG. 7*d*, by using alternate polarity patterns determined dynamically on row to row basis, adaptive to corresponding column data from row to row, positive and negative going drive differentials (705) may be made to cancel each other, with the purpose of reducing total drive differential value for each row; for an ideal situation of this exemplary illustration, using polarity patterns as adaptively determined result in total drive differential value of zero for each row and subsequently no Vcom fluctuation as depicted in FIG. 7*f*. For actual images, column signals have a range of values according to column data, not only VH and VL values, and positive and negative going drive differentials have different values that do not usually cancel each other to zero, but may be configured to counteract each other to a good degree by adaptive inversion in accordance with this invention.

According to an embodiment consistent with the invention of adaptive inversion driving scheme, a determination to either keep default polarity pattern or switch to an alternate polarity pattern is made on a row by row basis, adaptive to column data, with the purpose of reducing total drive differential value of column drive differentials in going from previous row to present row to be driven, in accordance with total drive differential value being sufficiently low or too high when using default polarity pattern. There are various approaches for finding an alternate polarity pattern for reducing the total drive differential value, with complexity depending on accuracy and extent of drive differential reduction required and on number of columns in an actual image display panel; to reduce the complexity, columns may be categorized into small groups for consideration.

According to an embodiment consistent with the invention, columns may be categorized into multiple groups for analysis and for adaptive determination of polarity pattern on group by group basis. For the above exemplary image, with columns regarded as in multiple groups of two adjacent columns each, in analysis of the column drive signals from row to row, total drive differential value is found to be 2 for each of group of Col1 and Col 2, group of Col 3 and Col 4, and group of Col 5 and Col 6, when default polarity pattern of column inversion is employed. For a group of only two columns using column inversion (that is polarity inversion between adjacent columns, e.g. +−) as default, the only alternate polarity pattern available is inversion of the polarity pattern (e.g. −+) for the row to be driven. For example, referring to FIG. 7*a*, considering the alternating and opposite high and low column data in Col1 and Col 2 in going from row to row, use of an alternate polarity pattern with opposite polarity or polarity inversion (706) for every row, is found to result in positive and negative drive differentials that are cancelling each other, thus minimizing (reducing total drive differential to zero in this ideal example) total drive differential value for this group of two columns. For group of Col 3 and Col 4, while polarity inversion is similarly preferred for Rows 2, 5 and 6 because of alternating and opposite high and low column data for going to such rows, no polarity inversion, is preferred for going from Row 2 to Rows 3 and from Row 3 to Row 4 (707) because of no change of column data there. The situation (708) for group of Col 5 and Col 6 is same as that for group of Col1 and Col 2. By regarding columns either as in one or multiple groups, same result as shown in FIG. 7*b* for the exemplary image may be achieved. Determination of an alternate polarity pattern, adaptive to column data, for reducing the total drive differential value for a large number of columns should become apparent for those familiar with digital signal processing, by following this exemplary case illustrated here for groups of only two columns.

As shown for the simple image of six rows by six columns, inversion of column inversion polarity pattern in going from one row to the next row, as is done in dot inversion, is apparently a good alternate polarity pattern complementary to the default polarity pattern of column inversion for reducing total differential drive value. An embodiment of the present invention comprises determination to switch from default polarity pattern of column inversion to alternate polarity pattern of dot inversion, based on parametric value, such as the total drive differential value, obtained from analysis step on row to row basis. Using the example in FIG. 7*b* for illustration, under an embodiment consistent with the present invention, determination for group of Col 1 and Col 2 and group of Col 5 and Col 6 is to switch to dot inversion (706,708) for every row after the first row, while determination for group of Col 3 and Col 4 is to keep default polarity pattern of column inversion (707) for rows 3 and 4 and to switch to dot inversion for rows 2, 5, and 6. Determination to switch from default to alternate polarity pattern is based on value of parametric gauge such as total drive differential exceeding threshold value. Analysis of column signals to obtain parametric gauge value and determination between default and alternate polarity pattern are performed dynamically on row to row basis.

Both column inversion scheme and dot inversion scheme employ inverting voltage polarity going from column to column; the difference between them is that the former keeps same voltage polarity for a column in going from row to row while the latter inverts voltage polarity as well in going from row to row. Because of high spatial frequency of polarity inversion (frequency is maximum when polarity inversion is occurring between adjacent cells) used in these inversion schemes, these schemes balance number of positive going drive differential against number of negative going drive differentials, since image data variations are typically gradual across many columns in most natural images. Problems arise for certain images such as specialized images generated for panel testing purposes, since column inversion may not obtain adequate balance of drive differentials for certain specialized images while dot inversion may not obtain adequate balance of drive differentials for other specialized images. Image patterns with high adjacent cell data variations along a column may incur excessively high total differential drive with column inversion, while image pattern with high color sub-pixel cell data variations may incur excessively high total differential drive with dot inversion. According to an embodiment consistent with the invention, by determining polarity pattern between column inversion or dot inversion schemes on a row by row basis in scan driving of LCD panel, in accordance with result from analysis of column data, adaptive inversion scheme provides row by row dynamic polarity patterns that are effective for reducing drive differentials regardless of image patterns, even for specialized image patterns in panel testing. Because of the dynamic as well as adaptive nature of adaptive inversion scheme according to the present invention, adaptive inversion scheme may comprise many exemplary variations of the scheme as disclosed herein, including one embodiment of the scheme as presented in terms of switching between column and dot inversion driving schemes in a dynamic adaptive manner based on analysis results of image data on a row to row basis, While polarity pattern of column inversion, with inverting polarity between adjacent columns (e.g. +−+−+− or −+−+−+), is being used as default polarity pattern in exemplary example presented here, consistent with the present invention, adaptive inversion scheme may employ other polarity pattern variations as the default polarity pattern, such as patterns with polarity inversion at intervals of specific number of cells (e.g. +++−−−+++−−−) or different polarity patterns between groups or sections of cells (e.g. ++−−−−++, +−+−+−, −+−+−+, ++++−−−−, etc). While switching to dot inversion is being used as alternate polarity pattern in exemplary examples presented here, consistent with the present invention, adaptive inversion scheme may employ other polarity pattern variations as the alternate polarity pattern, such as inversion of any default polarity pattern or other polarity patterns as revealed in analysis by taking into consideration column data to be driven for present row and column data for previous row.

An embodiment consistent with the present invention comprises starting first row of a frame employing default polarity pattern, such as polarity pattern of column inversion according to an embodiment, as shown in the example of FIG. 7*b*. For achieving DC balance, polarities of drive signals should be inverted from frame to frame. Although polarity pattern is dynamically determined row by row in adaptive inversion scheme, as long as polarity pattern of first row of a frame is inverted from that of previous frame and as long as frame data have not changed significantly between sequential frames, dynamically determined polarity patterns adaptive to column data in accordance with adaptive inversion scheme are expected to be closely the inversion of corresponding polarity patterns of previous frame, for most of the time, without a need to record dynamically determined polarity patterns and to invert them for use for next frame among every two frames. Consistent with the present invention, polarity pattern for first row is a default polarity pattern that is being inverted between frames, for the purpose of achieving DC balance of drive signals between multiple frames.

In accordance with preference in certain applications, an embodiment consistent with the present invention comprises a selection control to record polarity patterns determined for a frame and to re-deploy those patterns (and their inverted patterns) for at least a following frame; exemplary applications include displaying static images, displaying sequential 3D stereoscopic right and left eye images in sub-frames, displaying same color sub-frames in sequential color driving, and achieving special low noise or low power consumption conditions. For example, dynamic polarity pattern determination adaptive to column data may be enabled for one in every two frames, reusing inversion of polarity patterns determined and recorded in a previous frame for a following frame. The tradeoff of additional hardware resource for recording and re-deploying determined polarity patterns should be considered relative to overall application requirements.

An embodiment consistent with the present invention comprises regarding columns as in one group or multiple groups for consideration. Categorizing columns into multiple groups for consideration offers flexibility and variability in polarity patterns being dynamically determined adaptive to column data from row to row. When polarity patterns are determined with the purpose to minimize drive differential from row to row, the determination process is simplified when groups of small number of columns are being considered individually. Columns in a group are not necessarily contiguously located and group categorization may be according to a combination of cell configuration factors, including position on a row, pixel colors, or sub-frame association, or other application conditions. Columns in a group are commonly contiguously located but not necessarily so.

An embodiment consistent with the present invention comprises an analysis step to obtain total drive differential value by summing, for all columns in each group, drive differentials between column drive signals for present and previous rows, taking voltage polarity into account under assumption of default polarity pattern. (The terms "present row", "row to be driven", or "present row to be driven" are used interchangeably to mean same.) Drive differential (Drive_Diff) for one column is the difference between present drive signal level (Present_Drive) and previous drive signal level (Previous_Drive) and total drive differential value (Total_Drive_Diffs) is given by sum of Drive_Diff's for all columns in the group, which is same as difference between sum of Present_Drive's (Sum_Present_Drives) for all columns in the group and sum of Previous_Drive's (Sum_Previous_Drives) for all columns in the group; that is:

$$\text{Total_Drive_Diffs}=\text{Sum_Present_Drives}-\text{Sum_Previous_Drives}$$

In the analysis step to obtain total drive differential value of column drive signals for present row to be driven, an embodiment consistent with the present invention comprises use of either full or partial resolution of column drive signals or corresponding column data. For practical reasons, there is no need to compute using full resolution of column signals or column data in the analysis step; full resolution of column drive signals is typically up to six or more bits and partial resolution as low as one (e.g. VH=1 and VL=0 as used in the exemplary illustration of FIG. 7) or two bits may be found to be adequate for many applications. For implementation simplicity, digital image column data can also be used for this analysis, instead of actual analog column drive signals.

An embodiment consistent with the present invention comprises an option to apply scaling to drive signals (Scaled_Present_Drive and Scaled_Previous_Drive) by multiplying drive signals with scaling coefficients before summing of drive signals in the analysis. The reason for this is that actual driving of columns may include certain signal conditioning schemes to improve driving speed, such as column signal overdriving. To account for changes made to column drive signals in actual operation, scaling factors may be applied to column drive signals in the analysis for obtaining the drive differential parametric value; that is:

Total_Drive_Diffs=Sum_Scaled_Present_Drives−Sum_Scaled_Previous_Drives

An embodiment consistent with the present invention comprises a determination step to either keep default polarity pattern or switch to alternate polarity pattern based on a parametric value, such as total drive differential value, obtained in the analysis step, wherein an appropriate threshold value is used for comparison with the parametric value obtained in the analysis step. For the above example of an exemplary six row by six column image of FIG. 7*a*, individual column drive differential and the threshold value are both given a value of 1 for illustration purpose only. For actual images with hundreds of rows and columns, an appropriate threshold value may be set relatively to be equivalent to a small fraction of worst case total drive differential value for all columns under analysis. The threshold value may also comprise variability and dependency on image data, panel characteristics, or application conditions. For examples, the threshold value may be set lower for larger COM loading panels to compensate for increased difficulty for Vcom fluctuations to settle due to larger COM resistance, or the threshold value may be configured to be lowered when switching to alternate polarity pattern is too infrequent and to be raised when switching is too frequent, or the threshold value may be varied over a small range in order to avoid creating visible artifacts due to effects from fixed switching positions. Alternatively, switching to alternate polarity pattern may be skipped over once or several times or on occasions according to certain application conditions, to randomize switching positions in order to avoid potential visual artifacts due to effects from fixed switching positions.

Other than analysis of drive differentials to obtain total drive differential value as described above, other parametric values may also be obtained for gauging total magnitude of simultaneous column driving signals between rows, such as by image pattern or color pattern based parametric analysis; however, total drive differential value is preferred for avoiding complexity in interpreting image and color patterns. For example, parametric detection of certain colors or certain GUI patterns may be employed in analysis. An embodiment consistent with the present invention comprises determination of polarity pattern based on at least a parametric analysis of column drive signals for present and previous rows, for each group of columns, taking drive polarity into account.

Consistent with the invention, polarity pattern for first row of a frame is inverted from corresponding polarity pattern of a previous frame, for DC balance on average consideration; this polarity inversion between frames is with respect to between frames for addressing a same set of cells. In the case of sequential color driving scheme, color sub-frames should be considered separately; that is, polarity pattern inversion between frames for DC balance purpose should be considered for each color separately for the case of sequential color driving scheme.

Figure 8:
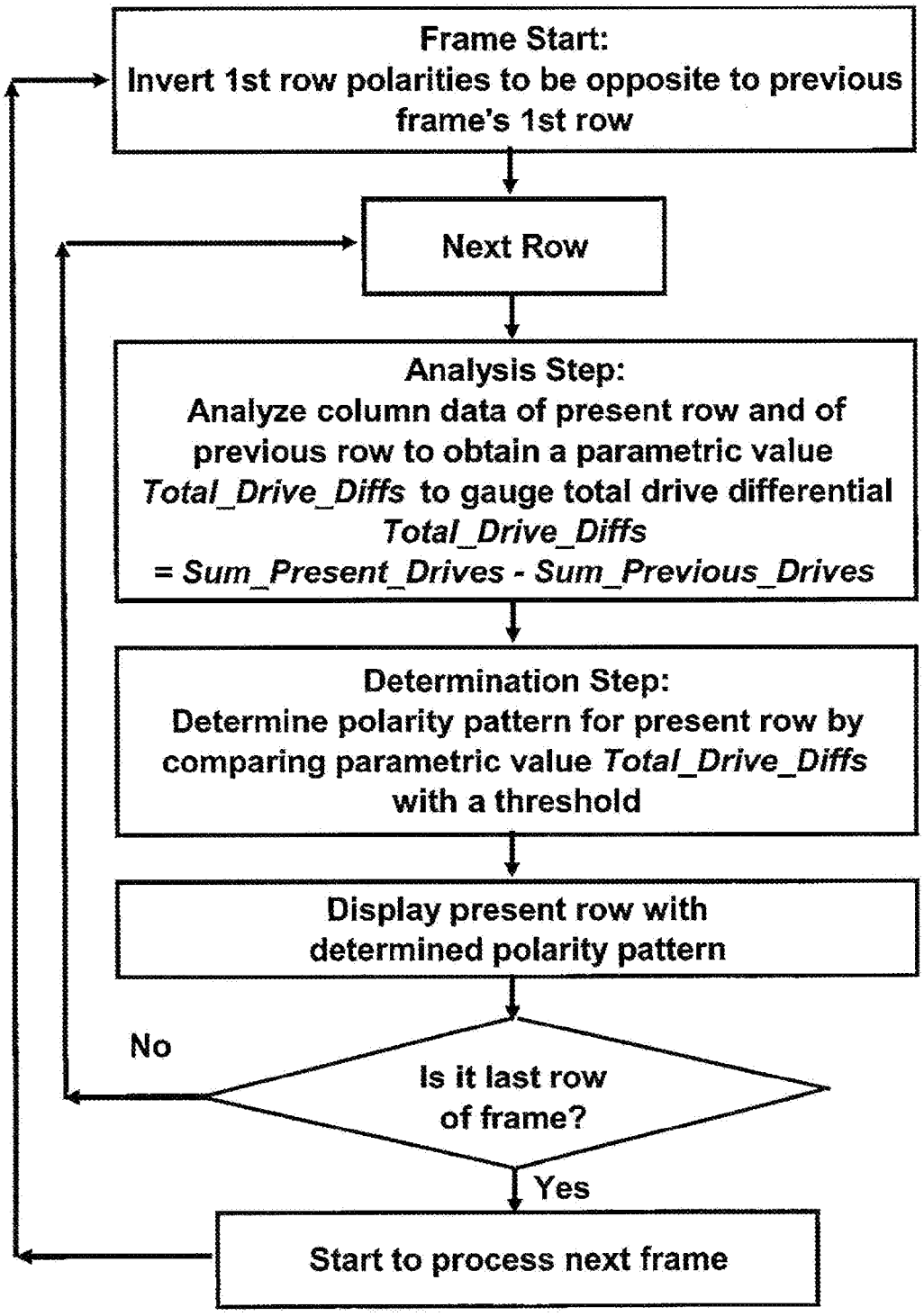
FIG. 8 shows the functional diagram for adaptive.

FIG. 8 shows functional diagram of a scan driving method for LCD panels comprising varying of polarity pattern adaptive to column data, wherein polarity pattern is dynamically determined on a row to row basis, after the first row, by consideration of column data to be driven for present row and column data for previous row, regarding columns as in one or multiple groups, said consideration includes at least an analysis step to obtain total drive differential value by summing, for all columns in each group, drive differentials between column drive signals for present and previous rows, taking voltage polarity into account under assumption of a default polarity pattern, and a determination step to either keep default polarity pattern or switch to alternate polarity pattern for each group, based on total drive differential value obtained in the analysis step.

Figure 9:
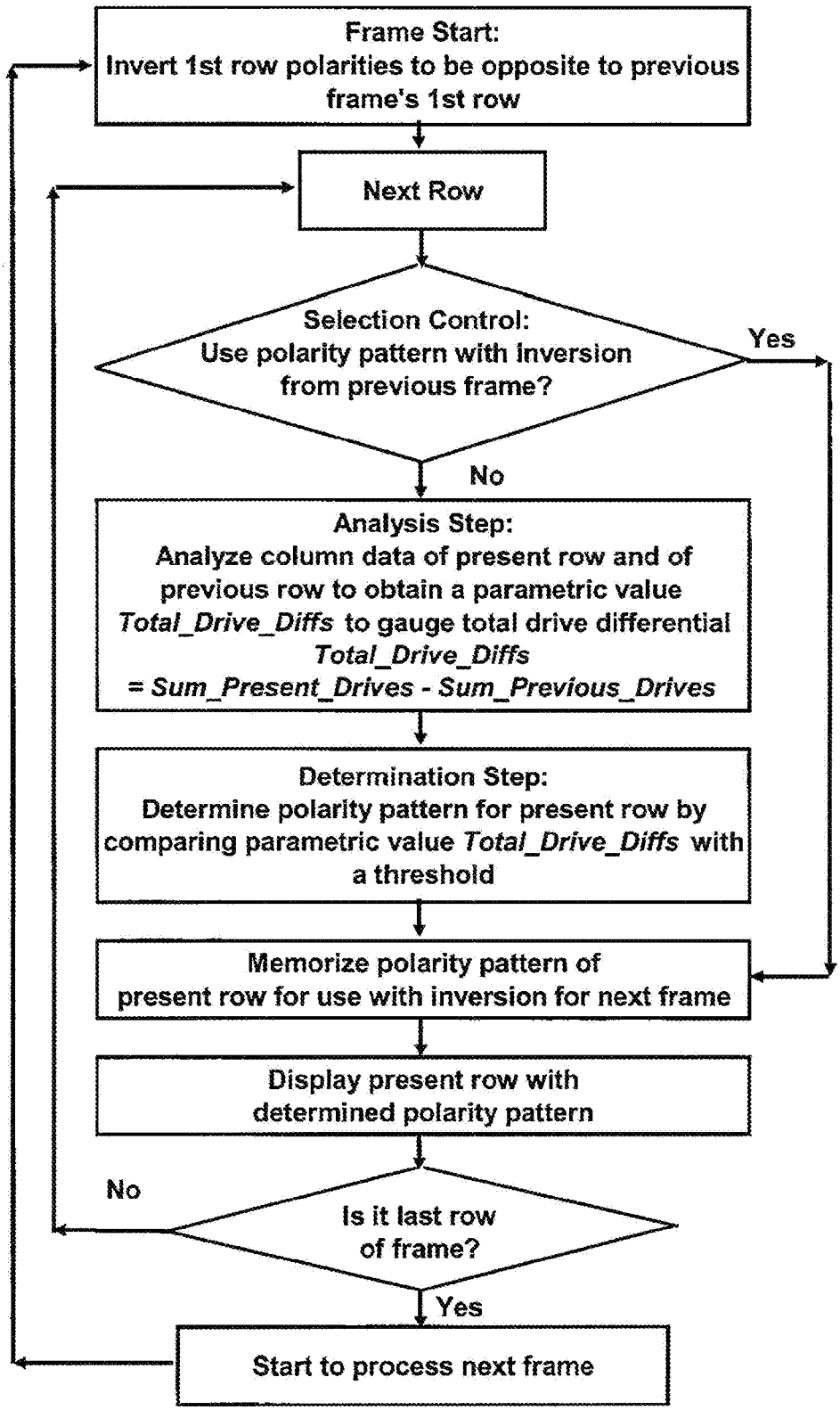
FIG. 9 shows the functional diagram for adaptive.

FIG. 9 shows the function diagram of a scan driving method for LCD panels comprising varying of polarity pattern adaptive to column data and including a selection control to record polarity patterns determined in a frame and to redeploy those patterns (and their inverted patterns) for a subsequent frame.

Selection of polarity pattern of column inversion as default polarity pattern is based on low power and low noise advantage, in comparison to dot inversion, an embodiment consistent with the present invention of adaptive inversion driving scheme.

FIG. 10*a* shows drive pattern for an exemplary image pattern in accordance with an embodiment of the present invention wherein default polarity pattern is the polarity pattern of column inversion and alternate polarity pattern is the polarity pattern of dot inversion, in an illustration of adaptive inversion driving scheme comprising varying of polarity pattern adaptive to column data on a row to row basis. As illustrated in FIG. 10*a*, for rows R1 to R3 (1001) and R10 to R12 (1003), default column inversion polarity pattern is kept (1004, 1006) because value of Total_Drive_Diffs is found not to exceed a threshold value for those rows; but for rows R4 to R9 (1002), alternate dot inversion polarity pattern is deployed (1005) because value of Total_Drive_Diffs is found to exceed threshold value for those rows if default column inversion polarity pattern is kept.

FIG. 10*b* shows drive pattern for an image pattern slightly different from that of FIG. 10*a*, where value of Total_Drive_Diffs is found to exceed the threshold for rows R6 and R7 (1008) only, resulting in a smaller image pattern region (1007) of FIG. 10*b* than the image pattern region (1002) of FIG. 10*a*, where determination is made for switching to alternate dot inversion polarity pattern. As indicated in both FIG. 10*a* and FIG. 10*b*, the drive patterns between sequential frames of N and N+1 have opposite polarities, in accordance with an embodiment of adaptive inversion driving scheme for achieving DC balance for the LC cells.

FIG. 11 shows drive patterns for the same exemplary image pattern of FIG. 10*a*, in accordance with an embodiment of the present invention, wherein columns are regarded as in multiple groups for consideration instead of regarding columns as in one group in FIG. 10*a*. As illustrated, polarity patterns for group of c3 and c4 or group of c5 and c6 are switch to dot inversion for rows R4 to R9 (1101), when Total_Drive_Diffs values are found to exceed threshold value for those rows. Because of invariant column data for group of c1 and c2 or group of c7 and c8, default polarity pattern of column inversion is determined to be kept for them (1102, 1103), based on Total_Drive_Diffs values not exceeding threshold value for these groups of columns. As illustrated, drive patterns between sequential frames of N and N+1 have opposite polarities for achieving DC balance. At the expense of increased hardware complexity, drive patterns determined for columns regarded as in multiple groups would result in reduced Total_Drive_Diffs values and subsequently reduced Vcom fluctuations, in comparison to drive patterns determined for columns regarded as in one group.

According to an embodiment consistent with the invention, a scan driving method for LCD panels comprises varying of polarity pattern adaptive to column data, wherein columns are regarded as in one group or multiple groups, and wherein polarity pattern for first row is inverted from polarity pattern for first row of previous frame and polarity patterns for subsequent rows are dynamically determined on a row to row basis by consideration of column data to be driven for present row and column data for previous row, said consideration including at least a group by group analysis step to obtain a parametric value based on column drive signals for present and previous rows, for each group, taking voltage polarity into account under the assumption of default polarity pattern, and a group by group determination step to either keep default polarity pattern or switch to alternate polarity pattern, based on the parametric value obtained in said analysis step.

In accordance with an embodiment consistent with the present invention, a scan driving method for LCD panels comprises varying of polarity pattern adaptive to column data, wherein polarity pattern is dynamically determined on a row to row basis, by consideration of column data for at least the present row to be driven and column data for previous row, said consideration including an analysis of column data and a determination of polarity pattern based on results from said analysis, and wherein configurable and programmable means are incorporated into the analysis and determination steps to accommodate differences in LCD panels and driving schemes.

In accordance with an embodiment consistent with the present invention, a scan driving method for LCD panels comprises varying of polarity pattern adaptive to column data, wherein the polarity pattern is dynamically determined adaptive to the image to be displayed, by consideration of image data, said consideration including an analysis of image data and a determination of polarity pattern based on results from said analysis.

Other embodiments consistent with the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A scan driving method for LCD panels comprises varying of polarity pattern adaptive to column data, wherein a polarity pattern is dynamically determined on a row to row basis by consideration of column data to be driven for a present row and column data of a previous row, regarding columns as in one or multiple groups, said consideration includes at least an analysis step to obtain a total drive differential value for each group by summing drive differentials between column drive signals for present and previous rows, for all columns in each group, taking voltage polarity into account under assumption of a default polarity pattern, and a determination step to either keep the default polarity pattern or switch to an alternate polarity pattern, for each group, based on the total drive differential value obtained in the analysis step.

2. A scan driving method for LCD panels comprises varying of polarity pattern adaptive to column data, wherein a polarity pattern for a first row is inverted from a polarity pattern for a first row of a previous frame and wherein polarity patterns for subsequent rows are dynamically determined on a row to row basis by consideration of column data to be driven for a present row and column data for a previous row, regarding columns as in one or multiple groups, said consideration includes at least an analysis step to obtain a total drive differential value for each group by summing drive differentials between column drive signals for present and previous rows, for all columns in each group, taking a voltage polarity into account under assumption of a default polarity pattern, and a determination step to either keep the default polarity pattern or switch to an alternate polarity pattern, for each group, based on total drive differential value obtained in the analysis step.

3. A scan driving method for LCD panels comprises varying of polarity pattern adaptive to column data, wherein a polarity pattern for a first row is inverted from a polarity pattern for a first row of a previous frame and wherein polarity patterns for subsequent rows are dynamically determined on a row to row basis, by consideration of column data to be driven for a present row and column data for a previous row, regarding columns as in one or multiple groups, said consideration includes at least an analysis step to obtain a parametric value for each group based on column drive signals for present and previous rows, for each group, taking a voltage polarity into account under the assumption of a default polarity pattern, and a determination step to either keep the default polarity pattern or switch to an alternate polarity pattern, for each group, based on parametric value obtained in said analysis step.

4. The method of claim 1, 2, or 3 wherein a polarity pattern for a first row of a frame is said default polarity pattern or a pre-determined polarity pattern, and wherein a polarity pattern for a first row of a frame is inverted between frames.

5. The method of claim 1, 2, or 3 wherein said default polarity pattern is a polarity pattern for a column inversion driving scheme and said alternate polarity pattern is a polarity pattern for a dot inversion driving scheme.

6. The method of claim 1, 2, or 3 wherein said analysis step to obtain said total drive differential value or parametric value is performed by using either full or partial resolution of column drive signals or corresponding column data and wherein said analysis may further include scaling of column drive signals or corresponding column data.

7. The method of claim 1 or 2 wherein said determination step to switch to the alternate polarity pattern from the default polarity pattern is based on said total drive differential value obtained from said analysis step exceeding a threshold value, wherein said threshold value may comprise variability between frames and dependency on image data, panel characteristics, or application conditions; and wherein said determination to switch may be skipped over at least once in a frame in accordance with an application control feature.

8. The method of claim 1, 2, or 3 wherein columns may be categorized into a group according to column position on a row, cell configuration on a panel, pixel colors, or sub-frame association, and columns in a group are not necessarily contiguously located.

9. The method of claim 1, 2, or 3 wherein said varying of polarity pattern adaptive to column data includes a controlled feature to employ polarity patterns determined and recorded for a frame, including inversion of patterns, for a subsequent frame.

10. The method of claim 1, 2, or 3 wherein said varying of polarity pattern adaptive to column data is configured to reduce a total column drive differential value from row to row, in said dynamical determination of a polarity pattern for a present row to be driven.

11. The method of claim 1, 2, or 3 wherein said varying of polarity pattern adaptive to column data is configured to reduce power consumption or electrical noise in driving LCD panels, in said dynamical determination of a polarity pattern for a present row.

12. The method of claim 1, 2, or 3 wherein configurable and programmable means are incorporated into the analysis and determination steps to accommodate differences in LCD panels and in display applications.

* * * * *